US007247085B1

(12) United States Patent
Anderson

(10) Patent No.: US 7,247,085 B1
(45) Date of Patent: Jul. 24, 2007

(54) COMBINATION EDGER AND GRINDER FOR FLOORS

(75) Inventor: Martin L. Anderson, Maple Lake, MN (US)

(73) Assignee: National Carpet Equipment, Inc., Brooklyn Park, MN (US)

( * ) Notice: Subject to any disclaimer, the term of this patent is extended or adjusted under 35 U.S.C. 154(b) by 0 days.

(21) Appl. No.: 11/080,585

(22) Filed: Mar. 15, 2005

(51) Int. Cl.
*B24B 23/00* (2006.01)
*B24B 27/08* (2006.01)
*A47L 5/00* (2006.01)
*E01H 1/08* (2006.01)

(52) U.S. Cl. ..... 451/350; 451/351; 451/352; 451/353; 15/340.1; 15/340.2; 15/340.3

(58) Field of Classification Search ..... 451/350–353; 15/49, 50.1, 340.1, 340.2, 340.3, 340.4, 49.1
See application file for complete search history.

(56) References Cited

U.S. PATENT DOCUMENTS 1,609,508 A * 12/1926 Cavicchi ..... 451/353
1,626,742 A * 5/1927 Lockwood ..... 15/98
1,752,133 A * 3/1930 Wolgamood ..... 451/350
2,242,229 A * 5/1941 Burleigh ..... 451/353
2,618,798 A * 11/1952 Ohrt ..... 15/50.1
2,624,896 A * 1/1953 Atkin ..... 15/50.1
3,081,583 A * 3/1963 Vinella ..... 451/353
3,187,472 A * 6/1965 Martin ..... 451/350
4,122,576 A * 10/1978 Bevington et al. ..... 15/49.1
4,754,580 A * 7/1988 Mattson ..... 451/353
4,783,872 A * 11/1988 Burhoe ..... 15/98
5,241,946 A * 9/1993 Yelton et al. ..... 125/14
5,548,860 A * 8/1996 Weltikol et al. ..... 15/50.1
6,821,194 B1 * 11/2004 Troyer ..... 451/350

* cited by examiner

*Primary Examiner*—Joseph J. Hail, III
*Assistant Examiner*—Bryan R. Muller
(74) *Attorney, Agent, or Firm*—Nikolai & Mersereau, P.A.; Steven E. Kahm

(57) ABSTRACT

A combined floor edger and grinder having a grinding disk which can be adjusted from engaging the floor while flat to engaging the floor along a front, back or side edge of the disk, depending on the height adjustment of the wheels on either side of the frame. The wheels, shroud and handle can also be adjustable relative to the frame for moving the frame straight back and forth or at an angle such that with the disk adjusted to engage the floor on one side of the frame the wheels and handle can be adjusted such that they are angled with respect to a wall for use as an edger whereby a user can push the device along the edge of a wall in a straight line while edging. The shroud and disk sizes may be easily changed for different jobs. The shroud can be open or close ended.

10 Claims, 4 Drawing Sheets

COMBINATION EDGER AND GRINDER FOR FLOORS

BACKGROUND OF THE INVENTION

1. Field of the Invention

This invention relates to floor grinding machines for cement and other floors and more particularly to adjustments on the floor grinding machine to tilt the grinding disk to different positions for grinding the floor and turning the grinding machine into and edger.

2. Description of the Related Art

There are floor grinding machines which have a grinding disk which rotates to grind floors. The disk lays flat on the floor and the floor grinding machine is moved over the floor surface to grind the floor surface.

There are special floor grinders which can be hand held and guided for grinding floors along walls. These edging machines may have a smaller disk and are more labor intensive due to the small disk size and the necessity to guide the edger along the wall by hand. Other hand held grinders are used to grind down one high point in a floor, which needs to be smoothed down. For this purpose the edge of a disk grinder is used to smooth off a high point quickly without using the entire surface of the grinding disk.

SUMMARY OF THE INVENTION

A floor grinder having a disk is provided which has a pair of wheels in the back for supporting the weight of the grinder when not in use and for pushing the grinder over a floor when the grinder is in use. The front part of the grinder has a rotating disk to grind the floor. The pressure applied to the disk can be varied by the operator by placing more or less weight on the wheels of the grinder.

The rear wheels have an independently adjustable height to tilt the grinding disk to the front or along the sides of the floor grinding machine. With the weight of the floor grinding machine on a portion of the floor grinding disk the area of the floor engaging the disk can be changed to grind down a specified portion of the floor faster and more accurately than by using the flat surface of the entire disk.

The rear wheels and the handle can be turned to angle the floor grinding machine such that the nose of the machine is against the wall whereby the grinding machine becomes an edger with a tilted portion of the grinding disk in the corner and the wheels clocked to drive the grinder straight along the edge of the wall.

OBJECTS OF THE INVENTION

It is an object of the invention to tilt a floor grinding machine to use the edge of the grinding disk to grind down localized high spots in the floor quickly and more precisely.

It is an object of the invention to clock the wheels of the floor grinding machine to a specified angle to convert the floor grinding machine to an edger for faster and easier grinding of floors along walls.

It is an object of the invention to quickly and easy tilt the grinder to use a particular portion of the disk on the floor.

It is an object of the invention to quickly easy and accurately raise or lower the wheels relative the frame to tilt the floor stripping machine.

It is an object of the invention to quickly and easy clock the wheels of the grinder and edger to a specified angle to move the machine along a wall while pushing the grinder straight with the nose of the machine against the wall.

It is an object of the invention to quickly and easy turn the handle to a desired angle to move the machine along the wall while pushing straight with the nose of the machine against the wall.

It is an object of the invention to quickly and easy change disk sizes on the machine.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
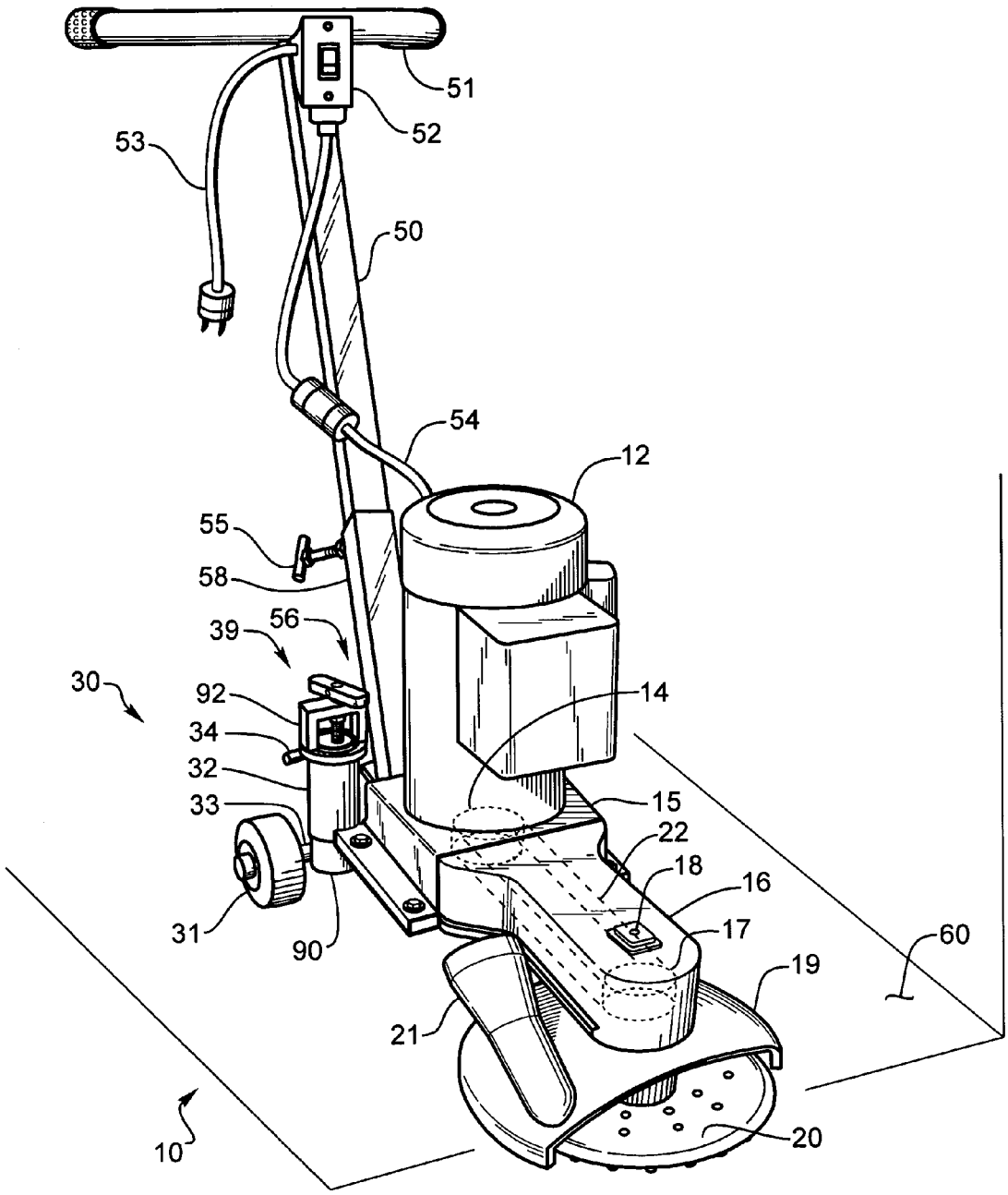
FIG. 1 is a front perspective view of the floor grinder.
Figure 2:
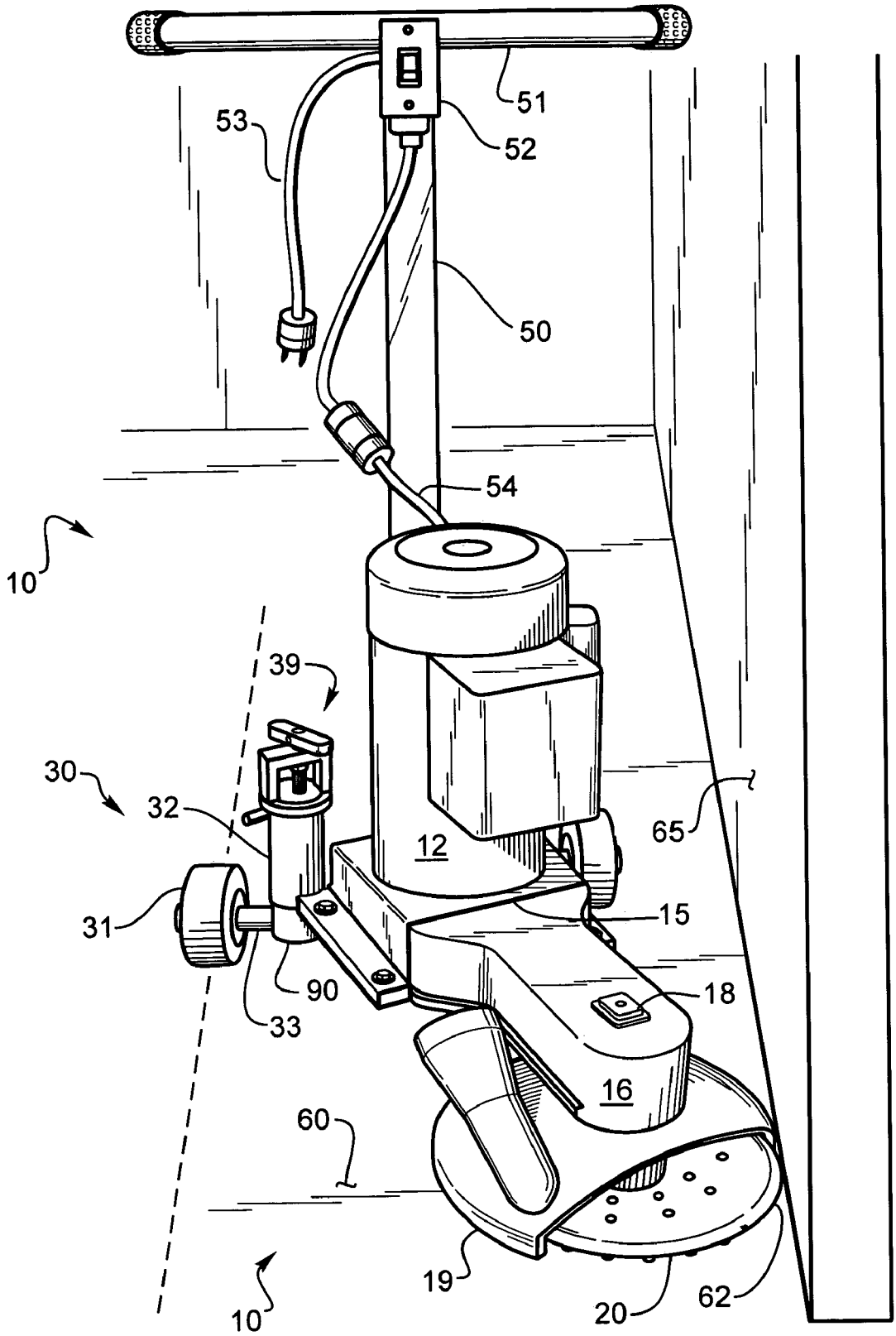
FIG. 2 is a front perspective view of the floor grinder with the wheels and handle clocked while used as an edger along a wall.

A combination of a floor grinding machine and edging machine 10 is shown in FIG. 1. In FIG. 1 the machine is used as a floor-grinding machine with the disk 20 flat on the floor 60. The base of wheels 31 are at the same height as the base of the grinding disk 20. As shown in this embodiment a shroud 19 covers most of the disk 20 and has a vacuum hose attachment 21 for removing the dust created by grinding the floor 60. A vacuum, not shown, sucks the dust and particles from the shroud 19 to keep the floor 60 clean and improve the grinders ability to contact the floor 60 for better grinding performance. The shroud 19 may be a full shroud or it can have the tip left open for engaging walls with the grinding disk 20 without interference from the shroud 19. The shroud 19 may pivot for adjusting the opening to the side of the shroud. The shroud 19 may be changed to a different size when the disc 20 is changed to a different size. In an alternative embodiment the shroud 19 may also be convertible from a full shroud to an open tipped shroud. Such convertible shrouds are commercially available from International Surface Preparation Corporation of Golden Colorado.

In the embodiment shown the floor grinding and edging machine 10 has a frame 15 for supporting an electric motor 12, which rotates pulley 14, and belt 22 for sending power to pulley 17 in the nose 16, which is attached to and extends from the front of frame 15. The pulley 17 turns disk 20 to grind floor 60. Although in this embodiment an electric motor 12 is used in conjunction with pulleys 14, 17 and belt 22 a hydraulic pump and a hydraulic motor could be used to turn disc 20, alternatively any means for powering the disk 20 may be used including a direct electric motor drive, a direct gasoline engine drive, and/or other power sources directly or indirectly powering the disk 20.

Figure 3:
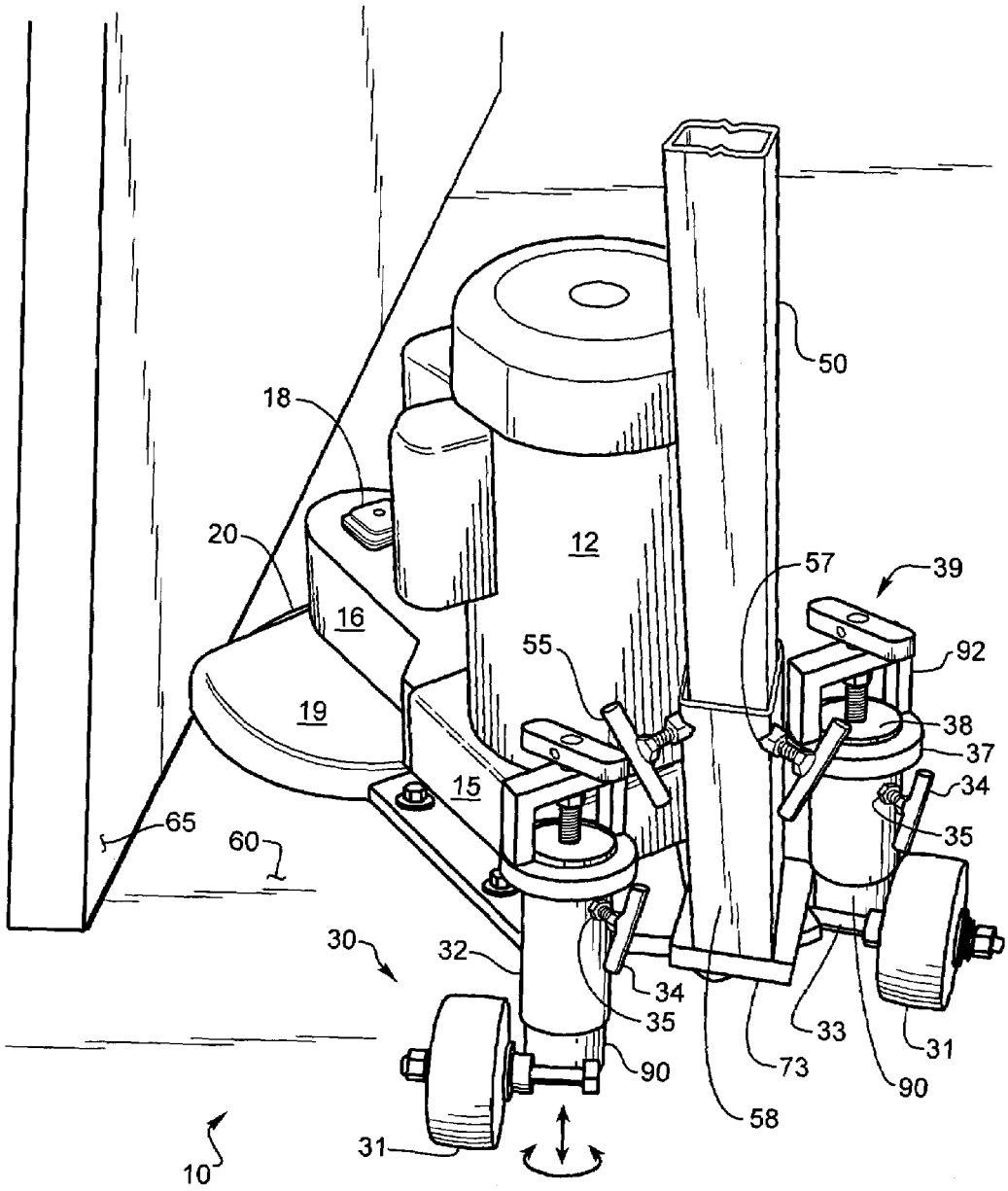
FIG. 3 is a rear perspective view of the floor grinder with the wheels and handle clocked while used as an edger along a wall.

As shown in FIG. 1 the handle 50 has a handle bar 51 at the top for steering and pushing the floor grinding and edging machine 10. The handle 50 has a power cord 53 leading to a switch 52, which has a cord 54 leading to the electric motor 12. The handle 50 has an adjustable length. As best seen in FIG. 3, the handle 50 telescopes in handle base 58. T-bolts 55 extending through threaded apertures 57 in handle base 58 and engage the handle 50 to lock the handle at the desired length.

Figure 4:
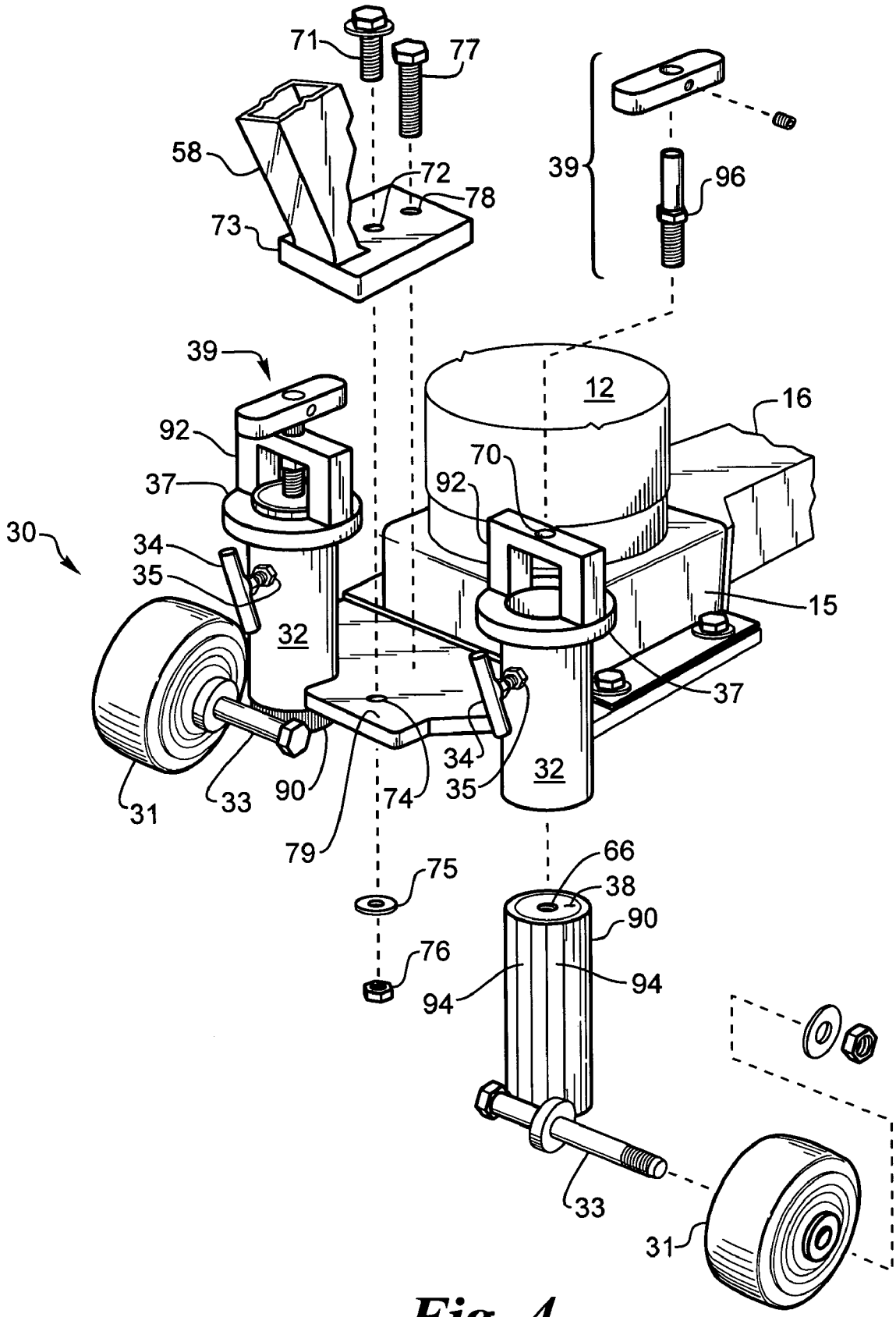
FIG. 4 is a rear exploded perspective view of the wheel height adjustment, wheel angle adjustment and the handle angle adjustment.

As shown in FIG. 4 wheel assembly 30 has wheels 31 with axles 33 connected to a cylinder 90, which telescopes into height adjustment tube 32. To adjust the height of the wheels 31 relative to frame 15 a height adjustment cap 38 having a threaded aperture 66 is attached at the top of cylinder 90 and T-bolt 39 passing through aperture 70 in height adjustment bracket 92 attached to flange 37 passes through the aperture 66 in the height adjustment cap 38. When the desired height is selected T-bolt 39 is rotated until the desired height is reached. T-bolt 39 is held in place relative to height adjustment bracked by a fixed stopper 96 on T-bolt 39 engaging the bottom of height adjustment bracket 92 preventing the T-bolt 39 from being pushed upward through aperture 70. Then T-bolt 34 in adjustment tube 32 is adjusted to press against a flat portion 94 of cylinder 90 to lock it in place relative to the height adjustment tube 32.

The cylinder 90 preferably has flat portions 94 located thereon to align with T-bolt 34 for setting the wheels 31 at predetermined settings such as at 45 degrees, zero degrees and minus 45. In this manner the T-bolts 34 turned in treaded apertures 35 on height adjustment tube 32 will engage the flat portion 94 of the cylinder 90 to lock the cylinder 90 in place. The flat portions 94 help prevent burring which may interfere with the rotation of height adjustment tube 32 in cylinder 90.

Adjusting the height of the wheels 31 relative to frame 15 will tilt the disk 20. For example raising the wheels 31 both by the same amount will tip the floor grinding machine and edging machine 10 forward such that the front edge of the disk 20 engages the floor 60 and the rest of the disk 20 will be off of the floor. A two-axis bubble sight level 18 directly over the center of the disk allows the adjustment of the disk 20 to the desired position. For example when the wheels 31 and disk 20 are at the same height the bubble in level 18 is centered and the disk 20 is flat on the floor. By lowering the wheels 31 both by the same distance the back edge of the disk 20 will contact the floor. By raising one wheel 31 and not the other or by raising one wheel 31 and lowering the other the disk 20 point of contact can be moved from the front to the side. With the disk 20 moved to one point of contact for example at the front only the grinder can concentrate on grinding down one spot or one strip. With the disk 20 contact point 62 on one side of the grinder, the grinder can be used as an edger for disk 20 contact along walls 65.

To aid in the use of the floor grinding machine and edging machine 10 along walls 65 the wheels 31 and handle 50 can be clocked so that the floor grinding machine and edging machine 10 can be pushed straight while the operator is a distance from the wall 65 such that the shroud 19 and handle bars 51 do not engage the wall 65 and interfere with the edging operation. With the wheels 31 clocked, the opening of the shroud 19 at the tip is pointed at the wall allowing the disk 20 to engage the wall 65 when the grinder is set to act as an edger.

As shown in FIG. 3 the wheels are shown as having been clocked. In order to turn the wheels to a predetermined angle such as one which is desirable for edging walls the t-bolt 34 is loosened and the angle of the wheel changed such as by allowing the end of t-bolt 34 to rest against one of the flat portions 94 on cylinder 90. In this way the wheel 31 can be angled at a preset angle such as left 45 degrees, centered, or right 45 degrees for a left side wall edging engagement, for straight grinding, or for a right side wall edging engagement respectively. When a flat portion 94 is selected T-bolt 34 is tightened to lock the wheel in place at the desired angle.

After the wheels 31 are set at the desired angle by angle adjustment 56, the handle 50 can be set at the desired angle. As shown in FIG. 4 the handle base 58 has an aperture 72 in handle pivot plate 73. A bolt 71 passes through the aperture 72 and also thought an aperture 74 in frame plate 79. A washer 75 and a nut 76 are then placed on the bolt 71 so as to form a pivot for the handle 50 to turn about the frame 15. When the handle 50 is set at a desired angle a bolt 77 in threaded aperture 78 in the handle pivot plate is turned until it engages the surface of frame plate 79 thus locking the handle 50 in place at the desired angle.

Both wheels 31 and the handle 50 having been suitably adjusted to the desired angle the user can push the floor grinding machine and edging machine 10 along a wall 65 for edging purposes or grinding purposes on floor 60.

Although the height and angle positions have been shown adjusted by means of apertures and t-bolts any means of adjustment may be used such as screw jacks.

The disk sizes and shrouds may be changed to accommodate the particular use of the floor grinding machine and edging machine 10.

Obviously, many modifications and variations of the present invention are possible in light of the above teachings. It is therefore to be understood that, within the scope of the appended claims, the invention may be practiced otherwise than as specifically described.

What is claimed is:

1. A floor grinding machine for grinding and edging floors comprising:

a frame having a motor mounted thereon, a nose attached to and extending in front of the frame, a disk attached to the front of the nose and resting on the floor, the disk rotated by a mechanical connection along the nose to the motor, with the disk being the only floor engaging support at the front of the floor grinding machine, a pair of wheels connected to the rear portion of the frame, one wheel on a first side of the frame and a second wheel on a second side of the frame, each wheel independently having a height adjustment mechanism for adjusting the height, of the wheel relative to the frame, such that by adjusting the height the engagement point of the disk to the floor changes position, the disk being flat on the floor when the base of both wheels and the base of the disk are at the same height relative to the frame, the wheels are mounted on cylinders, each having a plurality of flat portions thereon, which are pivotally attached to the frame by engaging a respective height adjustment tube attached to the frame such that the each wheel can be fixed at any of a plurality of selected angles relative to the frame by a T-bolt extending through the height adjustment tube and engaging a corresponding one of the flat portions of the cylinder, a handle attached to the frame for guiding and propelling the floor grinding machine along the floor.

2. A floor grinding machine for grinding and edging floors as in claim 1 wherein, the handle is pivotally attached to the frame such that the handle can be set at angles relative to the frame.

3. A floor grinding machine for grinding and edging floors as in claim 1 wherein, the handle has handlebars for ease of steering the floor grinding machine.

4. A floor grinding machine for grinding and edging floors as in claim 2 wherein, the handle has handlebars for ease of steering the floor grinding machine.

5. A floor grinding machine for grinding and edging floors as in claim 3 wherein, the handle has a telescoping portion for adjusting the length of the handle.

6. A floor grinding machine for grinding and edging floors as in claim 4 wherein, the handle has a telescoping portion for adjusting the length of the handle.

7. A floor grinding machine for grinding and edging floors as in claim 1 wherein, a shroud is connected to the nose for covering a portion of the disk.

8. A floor grinding machine for grinding and edging floors as in claim 2 wherein, a shroud is connected to the nose for covering a portion of the disk.

9. A floor grinding machine for grinding and edging floors as in claim 1 wherein, a level is attached to the nose over the center of the disk for indicating the tilt used in adjusting the engagement point of the disk with the floor.

10. A floor grinding machine for grinding and edging floors as in claim 2 wherein, a level is attached to the nose over the center of the disk for indicating the tilt used in adjusting the engagement point of the disk with the floor.

* * * * *